United States Patent [19]

Willemse et al.

[11] 4,068,937

[45] Jan. 17, 1978

[54] COPIER IMAGE TRANSFER SYSTEM

[75] Inventors: Adrianus H. Willemse, Grubbenvorst; Mathias J. J. M. Vola, Sittard, both of Netherlands

[73] Assignee: Oce-van der Grinten N.V., Venlo, Netherlands

[21] Appl. No.: 663,971

[22] Filed: Mar. 4, 1976

[30] Foreign Application Priority Data

Mar. 11, 1975 Netherlands ..... 7502874

[51] Int. Cl.[2] ..... G03G 15/16

[52] U.S. Cl. ..... 355/3 TR; 355/3 TE; 355/16

[58] Field of Search ..... 355/3 TE, 3 TR, 3 BE, 355/16; 96/1.4, 1 TE

[56] References Cited

U.S. PATENT DOCUMENTS 3,846,021 11/1974 Vola ..... 355/16

3,893,761 7/1975 Buchan et al. ..... 355/3 TR

FOREIGN PATENT DOCUMENTS 2,213,975 10/1973 Germany ..... 355/3 TR

*Primary Examiner*—A. D. Pellinen

*Attorney, Agent, or Firm*—Albert C. Johnston; Gerard F. Dunne

[57] ABSTRACT

A copying apparatus provided with a system for transferring electrostatic or powder images from a moving image supplying surface to a moving intermediate surface for temporary retention on the latter, wherein the respective supports of the surfaces are pressed together during image transfer and are kept apart at other times, is made with an arrangement which assures synchronized movement of the two surfaces for image transfer by driving the supports at slightly different speeds yet causing one of them to be driven by friction with the other, precisely at its speed, while and at the location where the surfaces are pressed together for image transfer.

14 Claims, 3 Drawing Figures

COPIER IMAGE TRANSFER SYSTEM

Figure 1:
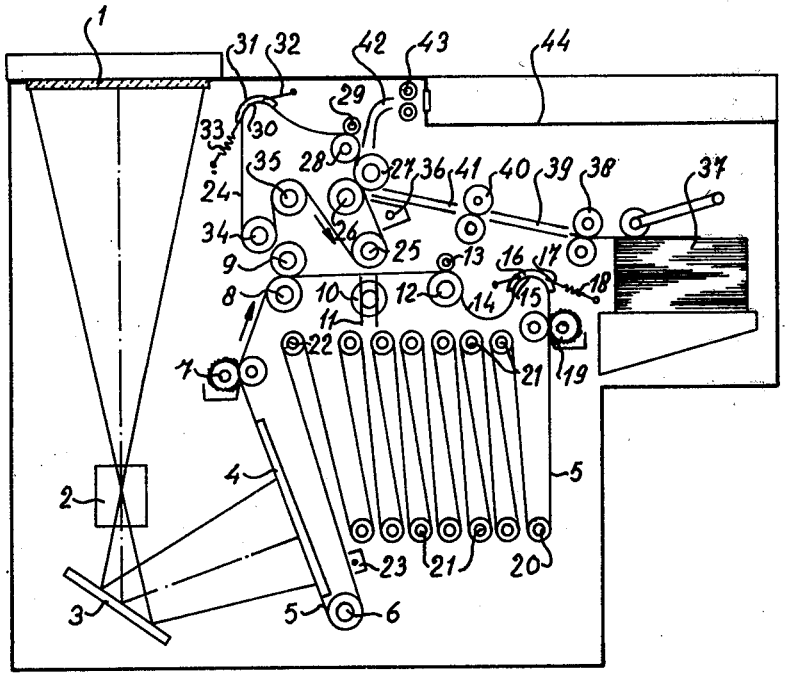

This invention relates to a copying apparatus provided with a system for transferring electrostatic or powder images, of a type in which the images are temporarily transferred to the surface of a moving intermediate support from a moving image supplying surface by the application of mechanical pressure to establish contact between these surfaces and maintain it during the image transfer, and the surfaces are held separate from each other when no image is to be transferred.

In a known system of that type, as disclosed for instance in U.S. Pat. No. 3,893,761, powder images can be transferred onto an intermediate support having the form of a roller or belt coated with a layer of very soft and resilient material, for instance a soft silicone rubber. In order to transfer an electrostatic charge pattern, the intermediate support is provided with an insulating surface layer, which need not be as soft as required for a powder image but must be slightly compressible so that the surfaces can be brought into uniform and close contact with each other.

During the image transfer in a system of the type mentioned, it is important that the image supplying surface and the intermediate support surface be driven in perfect synchronism. This, however, presents practical problems, because the synchronism in the respective drives may be deranged by inexactitudes which cannot be prevented. For instance, variations must be expected to occur in the dimensions of belts and rollers, the adjustments of the drive mechanisms used, and the adjustment of the pressure by which the surfaces are held in contact with each other. Such variations can cause image-fading and/or wear of the surfaces. Moreover, they may cause belts to become misaligned when the surfaces are on moving belts.

The object of the present invention is to provide an improved image transfer system of the type mentioned, which avoids or substantially alleviates the troubles caused by such inexactitudes. According to this invention, in an apparatus of the type above mentioned, the moving intermediate support surface which receives the image is driven with a speed that differs slightly from the speed with which the surface supplying the image is driven, and means are provided whereby the drive of one of these surfaces can be dominated by the drive of the other so that, when the two surfaces are pressed together for an image transfer, the one of them is brought to the different speed of the other by friction between the surfaces at the place where they are coengaged under pressure. In this way, various disturbing influences of the one surface on the other surface are restricted and a precise synchronization is obtained during the image transfer without decreasing the quality of the images transferred.

Preferably the speed of the drive of the one surface differs by 1 to 3% from the speed of the drive of the other surface.

When using either drums or belts to provide the moving surfaces, the invention can be carried out easily by incorporating an overrunning, or free-wheeling, clutch in the drive of the slower moving surface, so that this surface when engaged under pressure with the other surface will be moved faster than when it is being driven only by its own drive. In another embodiment making use of a belt, the required equalization of surface speeds is achieved by letting a loop be formed in the belt or by allowing a loop already present in it to become larger or smaller, depending upon the location of the loop and whether the speed of the belt surface is to be accelerated or slowed down by the pressure contact.

Figure 2:
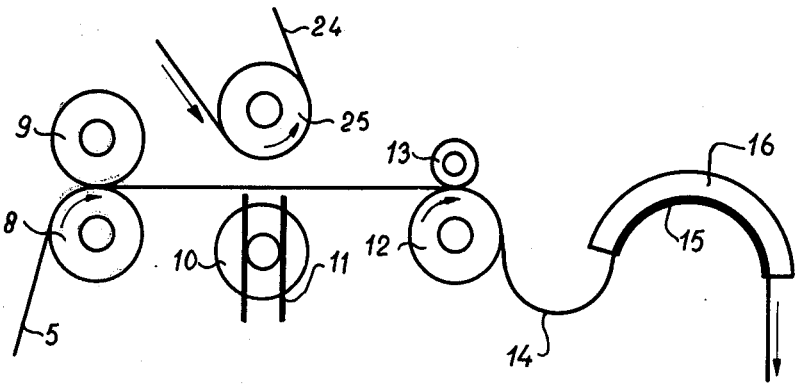
Figure 3:
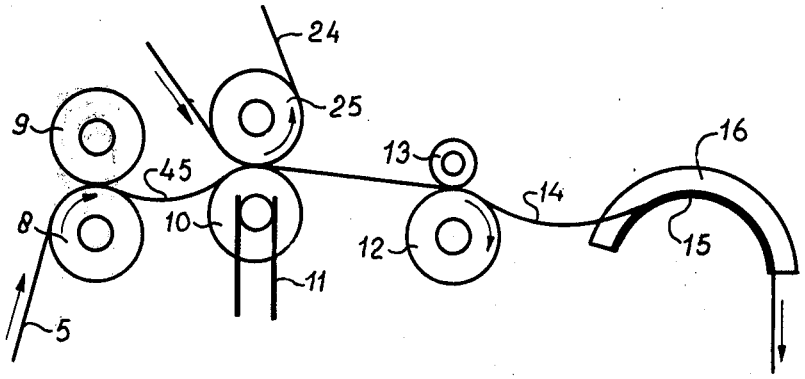

The invention will be further understood from the following description and the accompanying drawing of an illustrative embodiment thereof. In the drawing:

FIG. 1 is a schematic side view of a copying apparatus embodying the invention; and FIGS. 2 and 3 are schematic representations of a section of the apparatus in the non-image-transferring and the image-transferring positions respectively.

As shown schematically in the drawing, an endless belt 5 composed of a photoconductive layer on an electrically conductive support, after uniform charging by a corona device 23, is conveyed from a roller 6 along a suction box 4 against which the belt is held flat so that, while moving continuously, the belt will receive an image projected from an original on a glass exposure plate 1. The original is exposed by flash lamps (not shown) and the light reflected from it is projected through a lens 2 and then via a mirror 3 onto the belt 5. The use of flash exposure enables the belt to be moved continuously while the original is at standstill. The electrostatic charge pattern produced is developed by applying toner powder to it at 7, and the resulting powder image is carried forward along with the belt 5.

The belt 5 is driven continuously by a drive roller 8, which may be provided with a cooperating pressure roller 9, and which has an outer surface having a high coefficient of friction relative to the belt. Beyond the drive roller 8 the belt runs over a roller 10 which is movable toward and away from the belt, so up and down as seen in FIG. 1, in order to press the belt, when so desired, against an image receiving belt 24 which is guided about a roller 25 so that the powder image will be picked up by the belt 24, as described further hereinbelow.

The belt 5 moves beyond roller 10 over a smooth roller 12, which may run in contact with a pressure roller 13, and then hangs down into a loop 14 leading to a stationary curved surface 15 which serves for aligning the belt. The surface 15 is smooth or hairy, has raised guides 16 bordering it at either side of the belt and is provided with belt pressing means, such as a cloth or felt strips indicated at 17, which are held taut between two fixed points in the structure by a spring 18. The belt 5 then moves through a cleaning device 19 for removing residual powder, as generally known, and then is guided about a roller 20 to and over a series of freely rotatable reversing rollers 21, which together form a magazine for accumulating a great length of belt. At the exit end of the magazine the belt is guided over roller 22 to the roller 6, thereby again passing the corona device 23. The belt alignment device at 14–18 is described more particularly in U.S. Pat. No. 3,846,021.

The receiving belt 24, to which the image formed on belt 5 is transferred between the rollers 10 and 25, is made of or provided with a surface layer of a soft resilient material, for instance a soft silicone rubber.

The roller 25 can serve as a drive roller for the belt 24. Beyond roller 25, this belt is passed between rollers 26, 27 and dividing rollers 28, 29 to a stationary smooth surface 30 having lateral guides 31 and overlaid by a pressing cloth 32 held tight by a spring 33, so that a portion of the belt 24 will hang down freely in the space between the rollers 28, 29 and the surface 30. The belt 24 thus is kept aligned in the same manner as provided for belt 5 at surface 15. From surface 30 the belt 24 runs about a reversing roller 34, and from there about roller 35 and back to the roller 25.

A radiant heating device at 36 subjects the powder image transferred to the belt 24 to heat radiation which makes the powder image sticky at its surface so that it can easily be transferred from belt 24 to a sheet of copy paper. This paper is supplied from a pile 37, via rollers 38, guide 39, rollers 40 and guide 41, to the nip between belt 24 and roller 27, after which the copy sheet carrying the powder image is transported through guide 42 to rollers 43 which pass it onto a copy delivery table 44.

The transfer of the powder image from the surface of belt 5 to that of belt 24 will now be further described with reference to FIGS. 2 and 3. In the condition of the apparatus as shown in FIG. 2, in which no image transfer will take place, roller 8 drives belt 5 with a constant speed V, and belt 24 is driven with a constant speed which is 1 to 3% lower than V. In this condition, roller 10 is located in its guide 11 at a position sufficiently low that it does not engage the belt 5, and since roller 25 is constantly positioned at a location higher than the normal path of belt 5, the belt 5 runs straight on from roller 8 to roller 12.

Roller 12 is a smooth roller and is driven with a peripheral speed slightly greater than V, for instance 5% greater. Belt 5 is pressed lightly against roller 12 by roller 13, which turns freely and rests on the belt 5. Consequently, roller 12 will slip over the lower side of the belt when the belt portion leading to this roller is under tension, yet will take up any slack developed in this belt portion and transport the slack to a location downstream of roller 12.

When a powder image has been formed on belt 5 and is approaching the drive roller 8, a signal is given by any suitable means to actuate a motive device (not shown) by which roller 10 is moved upward in guide 11 until it presses belt 5 against belt 24 on roller 25. From the moment of this pressing contact, belt 5 is driven by the slightly slower moving belt 24 at the location of roller 10, so that both belts now move there with exactly the same speed. Thereby the powder image is transferred to belt 24.

Since belt 5 is being driven forward by drive roller 8 with speed V while being driven by belt 24 with a speed 1 to 3% lower, the belt 5 will increase in length and start sagging in the space between the rollers 8 and 10, as indicated at 45 in FIG. 3. At the same time, the portion of belt 5 passing over the smooth slipping roller 12 slackens a bit in speed relative to the portion thereof being drawn over the surface 15 and through the magazine formed by the rollers 21. Consequently, a slack belt portion 14 sagging between the smooth roller 12 and the surface 15 is shortened so that it forms a slightly less deep loop.

When the powder image has been completely transferred to belt 24, roller 10 is returned from its position of FIG. 3 to its inactive position of FIG. 2. The smooth roller 12 then takes up the slack in the portion of belt 5 extending to this roller from drive roller 8, and the loop 14 again becomes slightly larger. The apparatus is now ready for another image to be transferred from belt 5 to belt 24 in the manner described. Meanwhile, the image previously so transferred is carried on belt 24 through the heating station at 36 and then between rollers 26 and 27 for further transfer there to a sheet of copy paper.

While the illustrated embodiment of the invention is adapted for the use of a belt as the image-carrying surface, the image-receiving surface in this system need not be a belt but may be a drum instead. As already stated, the belt 5 can also be replaced by a drum, in which case a system as shown in FIGS. 2 and 3 for belt 5 can be employed for belt 24. Further, as already stated, in the use of either belts or drums a freewheeling clutch or a slip clutch can be used in the drive of one of the surfaces in order to ensure that the one surface will drive the other surface with exactly the same speed when the two surfaces are temporarily coupled for the image transfer.

What is claimed is:

1. In a copying apparatus comprising a first support movable to supply on its surface electrostatic or powder images and a movable intermediate support having a surface adapted to receive said images by transfer from said first support, at least one of said supports being an endless belt;

respective driving means for said supports for moving them continuously and operative to drive said belt at a speed greater than the speed of the other of said supports;

means operable while said supports are moving to press them together at a transfer location downstream from said belt driving means so that said belt will be driven at said location by frictional engagement with and at the lower speed of said other support for transfer of an image, and to disengage said supports after image transfer, whereby while said supports are pressed and moving together the greater speed of said belt driving means produces slack in the length of belt extending between said belt driving means and said transfer location;

and means operative upon disengagement of said supports to displace slack in said belt length downstream from and thus tension the belt at said transfer location.

2. Copying apparatus according to claim 1, said belt driving means being operative to drive said belt at a speed 1 to 3% greater than the speed of said other support.

3. Copying apparatus according to claim 1, said means to press said supports together comprising a roller which is displaceable bodily toward said supports to deflect said belt transversely into and hold it in frictional engagement with said other support for transfer of an image.

4. Copying apparatus according to claim 1, each of said supports being an endless belt, one of said belts normally extending from said belt driving means through said transfer location out of engagement with the other belt, and the other belt extending about a roller fixed at said transfer location, said means to press said supports together comprising a pressing roller which is displaceable bodily toward said fixed roller to deflect said one belt transversely into engagement with said other belt and hold said belts pressed together against said fixed roller for transfer of an image, said pressing roller being movable away from said belts to disengage them after image transfer.

5. Copying apparatus according to claim 4, said one belt being said first support and said other belt being said intermediate support.

6. Copying apparatus according to claim 1, said slack displacing means comprising roller means engaging and for slippably driving said belt at a location downstream from said transfer location at a speed exceeding said greater speed when the belt lead to said roller means is not under tension.

7. Copying apparatus according to claim 1, said belt driving means comprising a driving roller non-slippably engaged with said belt at a distance upstream from said transfer location, said slack displacing means comprising a further roller drivably engaging said belt at a location downstream from said transfer location and driven at a peripheral speed exceeding the peripheral speed of said driving roller, said further roller being slippable relative to the belt lead to it when said belt lead is under tension.

8. Copying apparatus according to claim 7, said driving roller being operative to drive said belt at a speed 1 to 3% greater than the speed of said other support and the peripheral speed of said further roller being about 5% greater than the peripheral speed of said driving roller.

9. Copying apparatus according to claim 1 and further comprising a stationary curved surface spaced downstream from said slack displacing means, said displacing means being operative to displace said slack into a hanging loop of said belt from which said belt leads slidably onto said curved surface, said curved surface being bordered by side guides engageable by either side edge of said belt, and pressure applying means trained yieldably over said belt at and pressing it against said curved surface to keep under tension the belt leading downstream from said curved surface.

10. In a copying apparatus comprising a first endless belt movable to supply on its surface electrostatic or powder images and a second endless belt having a surface adapted to receive images by transfer from said first belt, respective means for driving said belts continuously, including a first driving roller located upstream from an image transfer location and operative to drive one of said belts at a speed greater than the speed of the driving of the other belt;

said other belt extending about a roller fixed at said transfer location;

said one belt extending from said first roller through said transfer location and to a further driving roller positioned downstream from said location;

said further roller being operative to drive the belt lead to it at a speed exceeding the speed of said one belt at said first roller when said belt lead is not under tension, yet to drive said belt lead slippingly when it is under tension;

and a pressing roller displaceable bodily at said transfer location to deflect said one belt into engagement with said other belt and hold said belts pressed together against said fixed roller and moving together there at the lower speed of said other belt for transfer of an image, whereby while said belts are so pressed and moving together the greater driving speed of said first roller produces slack in the length of belt extending between said first roller and said pressing roller, said pressing roller being movable away from said belts to separate them after image transfer, whereby slack in said belt length is displaced by said further roller into a hanging loop of said one belt downstream from said further roller.

11. Copying apparatus according to claim 10, said one belt being said first belt.

12. Copying apparatus according to claim 10, said first roller being operative to drive said one belt at a speed 1 to 3% greater than the speed of said other belt and said further roller being driven at a peripheral speed about 5% greater than the peripheral speed of said first roller and being slippable relative to said belt lead under tension.

13. Copying apparatus according to claim 10, further comprising a stationary curved surface spaced downstream from said further roller and engaged slidably by the portion of said one belt leading from said loop, said curved surface being bordered by side guides engageable by either side edge of said belt portion, and pressure applying means trained yieldably over said one belt at and pressing it against said curved surface to keep under tension the belt leading downstream from said curved surface.

14. Copying apparatus according to claim 10, said one belt being said first belt, said first roller being operative to drive said one belt at a speed 1 to 3% greater than the speed of said other belt and said further roller being driven at a peripheral speed about 5% greater than the peripheral speed of said first roller and being slippable relative to said belt lead under tension, said apparatus further comprising a stationary curved surface spaced downstream from said further roller and engaged slidably by the portion of said one belt leading from said loop, said curved surface being bordered by side guides engageable by either side edge of said belt portion, and pressure applying means trained yieldably over said one belt at and pressing it against said curved surface to keep under tension the belt leading downstream from said curved surface.

* * * * *

UNITED STATES PATENT AND TRADEMARK OFFICE

CERTIFICATE OF CORRECTION

PATENT NO. : 4,068,937

DATED : January 17, 1978

INVENTOR(S) : Adrianus H. Willemse and Mathias J.J. M. Vola

It is certified that error appears in the above-identified patent and that said Letters Patent are hereby corrected as shown below:

Column 2, line 63, in place of "dividing" read --driving--.

Signed and Sealed this

Sixth Day of June 1978

[SEAL]

*Attest:*

RUTH C. MASON
*Attesting Officer*

DONALD W. BANNER
*Commissioner of Patents and Trademarks*